US008418323B2

(12) United States Patent
Chou

(10) Patent No.: US 8,418,323 B2
(45) Date of Patent: Apr. 16, 2013

(54) BUCKLE FOR SWIMMING/DIVING GOGGLES

(76) Inventor: Terry Chou, Tainan (TW)

( * ) Notice: Subject to any disclaimer, the term of this patent is extended or adjusted under 35 U.S.C. 154(b) by 203 days.

(21) Appl. No.: 13/091,131

(22) Filed: Apr. 21, 2011

(65) Prior Publication Data

US 2012/0266418 A1 Oct. 25, 2012

(51) Int. Cl.
*A44B 11/26* (2006.01)

(52) U.S. Cl.
USPC ..... 24/193; 24/170; 2/426; 2/448; 2/909

(58) Field of Classification Search ..... 24/170, 24/265 BC, 636, 68 SK, 629, 637, 68 E, 24/191, 193; 2/426, 428, 448, 909; 351/43
See application file for complete search history.

(56) References Cited

U.S. PATENT DOCUMENTS 3,043,902 A * 7/1962 Klein ..... 174/146
6,871,386 B2 * 3/2005 Chen-Lieh ..... 24/168
7,146,653 B2 * 12/2006 Chou ..... 2/426
7,296,306 B2 * 11/2007 Chou ..... 2/448
7,571,520 B2 * 8/2009 Shiue ..... 24/265 BC
7,631,400 B2 * 12/2009 Chiang ..... 24/170
7,856,674 B2 * 12/2010 Chou ..... 2/452
7,921,476 B2 * 4/2011 Chiang ..... 2/448
8,225,430 B2 * 7/2012 Chiang ..... 2/448
2008/0189837 A1 * 8/2008 Chiang ..... 2/431
2009/0100645 A1 * 4/2009 Weng ..... 24/170
2009/0229086 A1 * 9/2009 Chiang ..... 24/170
2012/0096632 A1 * 4/2012 Chou ..... 2/452

* cited by examiner

*Primary Examiner* — Robert J Sandy
*Assistant Examiner* — Michael Lee

(57) ABSTRACT

A buckle includes a coupling block engaged with a body of swimming/diving goggles. A pressing block is mounted to an outer side of the coupling block. A pin is mounted to an inner side of the pressing block and has a spacing to a pressing edge of an insertion hole of the coupling block. The inner side of the pressing block includes first and second surfaces. A fulcrum is located between the first and second surfaces and abuts a pressing face on the outer side of the pressing block. A section of a head strap is received in the insertion hole and wound around the pin. The pressing block can be pivoted about the fulcrum to move the pin away from the pressing edge of the coupling block to increase the spacing between the pin and the pressing edge, allowing loosening of the head strap.

7 Claims, 10 Drawing Sheets

BUCKLE FOR SWIMMING/DIVING GOGGLES

BACKGROUND OF THE INVENTION

The present invention relates to a buckle for swimming/diving goggles and, more particularly, to a buckle for swimming/diving goggles allowing easy adjustment of a length of a head strap.

Swimming goggles generally include two lenses, two frames, a bridge, a buckle, and a head strap. The buckle allows adjustment of a length of the head strap. FIG. 8 shows a conventional buckle 1' including an end with an engagement portion 11' for engagement with a body 3' of a pair of swimming goggles. The other end of the buckle 1' includes a coupling portion 12' for coupling with a soft head strap 2'. The coupling portion 12' includes pegs 121' and 122' at an intermediate portion thereof. A notch 123' is defined in a front end of the coupling portion 12'. The head strap 2' is extended between the notch 123' and the peg 121' and wound around the pegs 121' and 122' and extended between the notch 123' and the peg 121' again, fixing the head strap 2'. When adjustment of the head strap 2' is required, the user removes the body 3' from his or her head, loosens the head strap 2', and adjusts the length of the head strap 2', which is troublesome and time-consuming. However, the length of the head strap 2' after adjustment may not fit the head of the user. As a result, readjustment of the head strap 2' is required when the head strap 2' is either too tight or too loose. Furthermore, the head strap 2' deforms significantly at the bends wound around the pegs 121' and 122'.

FIG. 9 shows another pair of conventional swimming goggles including a pressing portion 4', a clamping portion 5', and a connecting portion 6'. The pressing portion 4' includes a post 41' around which a head strap 7' extends. The clamping portion 5' includes a clamping hole 51' and a retaining edge 52'. The head strap 7' is extended through the clamping hole 51' and retained by the retaining edge 52'. Thus, the head strap 7' can only extend around the post 41' without significant deformation. An end of the head strap 7' can be pulled to retain the head strap 7' by the post 41' and the retaining edge 52'. A user can push the pressing portion 4' towards the post 41' to increase the spacing between the post 41' and the retaining edge 52', as indicated by the double arrow, allowing loosening of the head strap 7'. In another approach, the user can push the pressing portion 4' outward to increase the spacing between the post 41' and the retaining edge 42', allowing loosening of the head strap 7', as shown in FIG. 10. An example of such a buckle is shown in U.S. Pat. No. 6,691,378 (Taiwan Utility Model No. 218191). However, the force for pushing the pressing portion 4' in either approach must be larger than the clamping force of the head strap 7', such that the hand of the user pushing the pressing portion 4' is liable to slip, failing to provide easy, convenient operation.

BRIEF SUMMARY OF THE INVENTION

An objective of the present invention is to provide a buckle for swimming goggles with operational convenience while providing reliable engagement.

A buckle for swimming/diving goggles according to the present invention is adapted to be mounted to a side of a body of the swimming/diving goggles and adapted to mount a head strap. The buckle includes a coupling block having a front end with a coupling portion engaged with the body. The coupling block further includes a rear end spaced from the front end of the coupling block in a longitudinal direction. The rear end of the coupling block has an insertion hole receiving the head strap. The coupling block further includes outer and inner sides spaced in a width direction perpendicular to the longitudinal direction. The insertion hole includes an inner peripheral wall. The inner peripheral wall includes a front end having a pressing edge facing the outer side of the coupling block. A recess is defined in the outer side of the coupling block and in communication with the insertion hole. The outer side of the coupling block further includes a pressing face behind the recess. A pressing block is mounted to the outer side of the coupling block and includes outer and inner sides spaced in the width direction perpendicular to the longitudinal direction. A pin is mounted to the inner side of the pressing block at a location corresponding to the recess and the pressing edge of the coupling block. The pin has a spacing to the pressing edge of the coupling block in the longitudinal direction. The inner side of the pressing block includes a first surface and a second surface located behind the first surface and having a slope different from that of the first surface. A fulcrum is located between the first and second surfaces and abuts the pressing face of the coupling block. The first and second surfaces are located corresponding to the pressing face of the coupling block. The outer side of the pressing block includes a pressing portion corresponding to the second surface.

An end of the head strap is extended forwards into the insertion hole of the coupling block and wound around the pin and extended rearwards out of the insertion hole. The head strap is folded in two and includes an outer section and an inner section.

When the pressing portion of the coupling block is pressed, the pressing block pivots relative to the pressing face of the coupling block about the fulcrum. The pin moves away from the pressing edge of the coupling block in the direction perpendicular to the longitudinal direction, increasing the spacing between the pin and the pressing edge in the longitudinal direction, allowing loosening of the head strap.

Preferably, the outer side of the coupling block includes an abutment face at the front end of the coupling block. The inner side of the pressing block includes a front, abutment end corresponding to the abutment face of the coupling block. The first surface is located between the fulcrum and the front, abutment end of the pressing block.

Preferably, the outer side of the coupling block further includes an inclined guiding face located behind the pressing face. The pressing block further includes a rear, arcuate, guiding end spaced from the front, abutment end in the longitudinal direction. The rear, arcuate, guiding end of the pressing block moves along the inclined guiding face of the coupling block when the pressing block is pressed.

Preferably, the pressing block includes two lugs, and two ends of the pin rotatably received in the two lugs. Alternatively, the pin can be integrally formed with the coupling block.

Preferably, the pressing edge of the coupling block is at an acute angle with the longitudinal direction.

Preferably, the head strap includes a plurality of teeth.

The present invention will become clearer in light of the following detailed description of illustrative embodiments of this invention described in connection with the drawings.

DETAILED DESCRIPTION OF THE INVENTION

Figure 1:
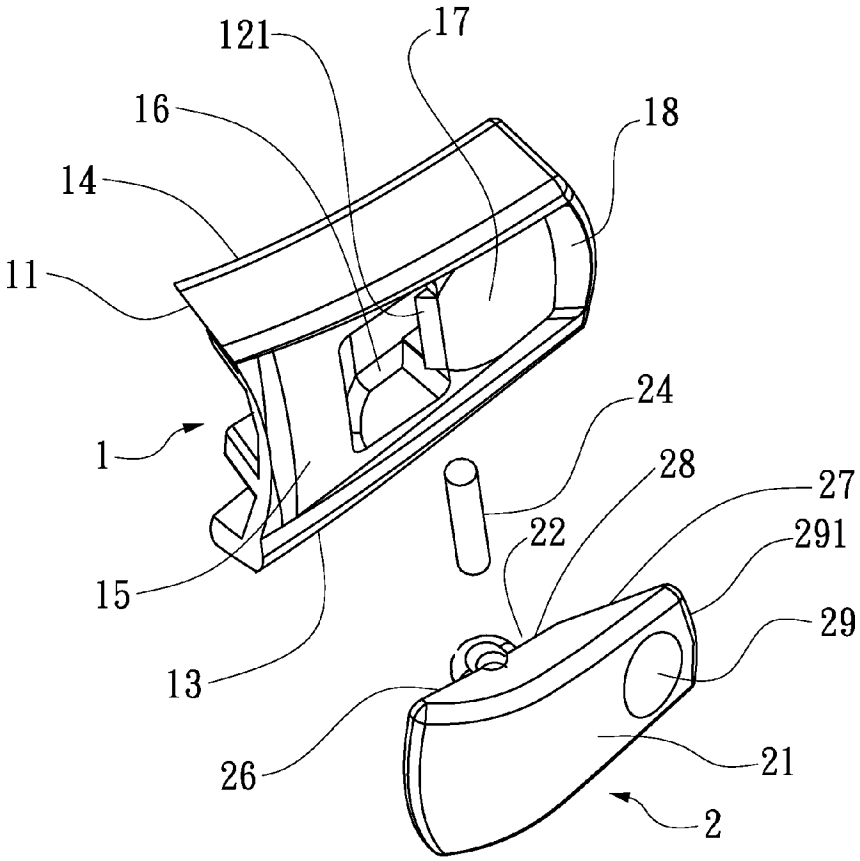
FIG. 1 shows an exploded, perspective view of a buckle for swimming/diving goggles according to the present invention.
Figure 2:
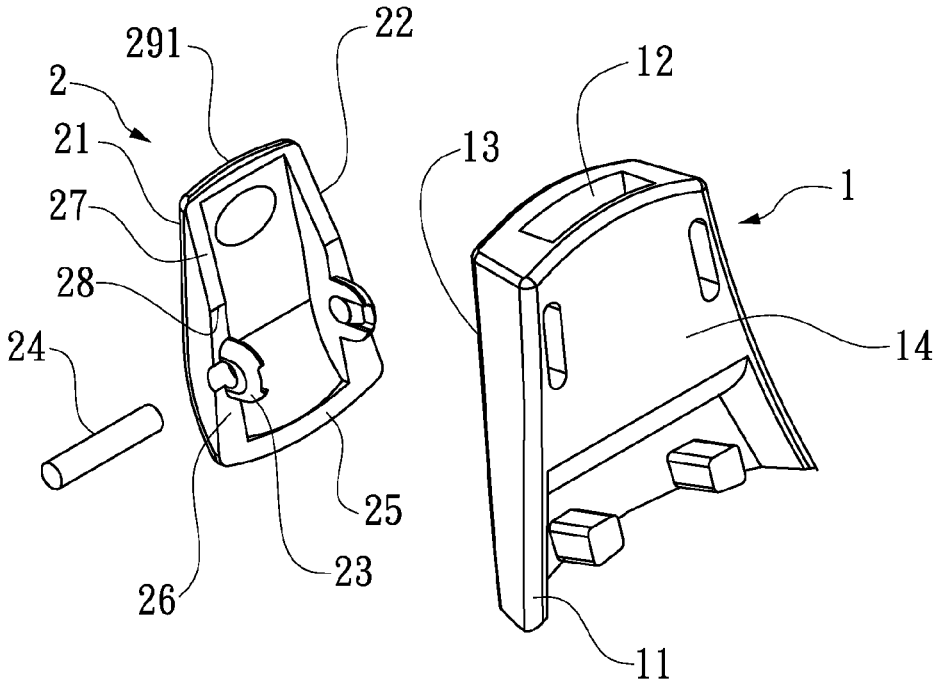
FIG. 2 shows another exploded, perspective view of the buckle of FIG. 1.
Figure 3:
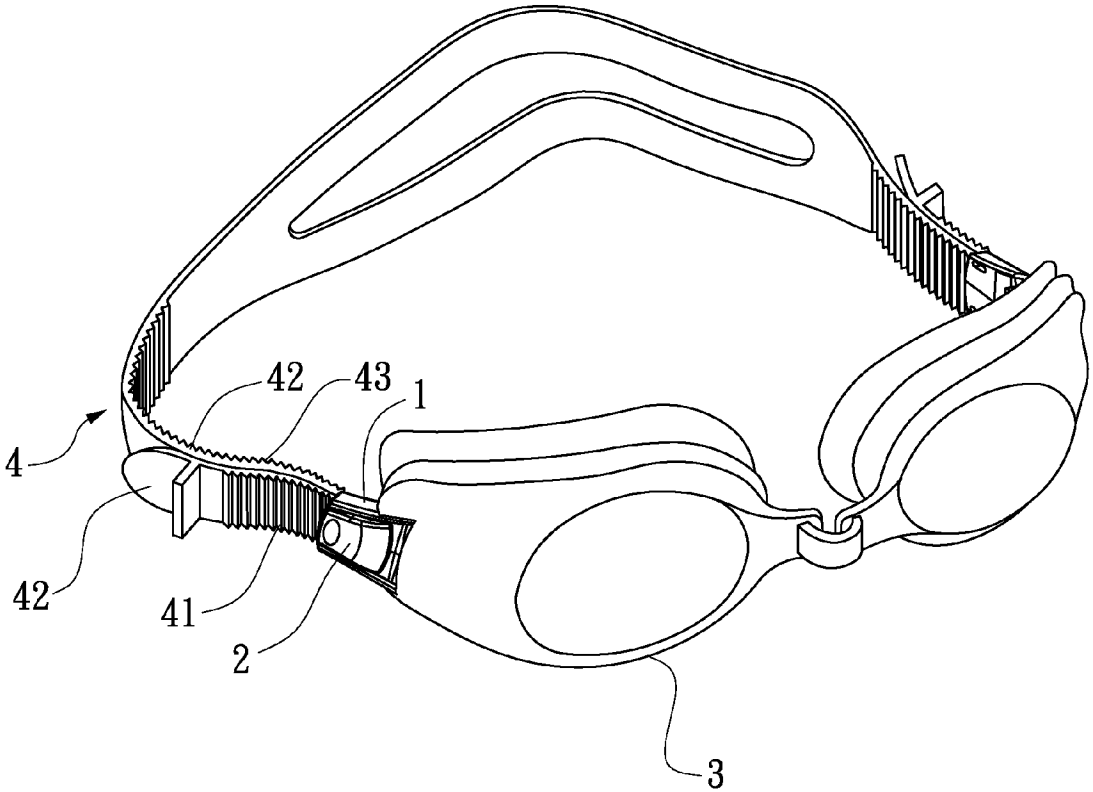
FIG. 3 shows a perspective view of swimming/diving goggles with the buckle of FIG. 1.

With reference to FIGS. 1-7, a buckle according to the present invention is mounted to a side of a body 3 of swimming/diving goggles for coupling with a head strap 4 that includes a plurality of teeth 41 on a side thereof. In the form shown, another buckle is mounted to the other side of the body 3.

The buckle according to the present invention includes a coupling block 1 and a pressing block 2. The coupling block 1 includes a front end having a coupling portion 11 engaged with the body 3. The coupling block 1 further includes a rear end spaced from the front end of the coupling block 1 in a longitudinal direction. The rear end of the coupling block 1 has an insertion hole 12 receiving the head strap 4. The coupling block 1 further includes outer and inner sides 13 and 14 spaced in a width direction perpendicular to the longitudinal direction. The insertion hole 12 includes an inner peripheral wall. The inner peripheral wall includes a front end having a pressing edge 121 facing the outer side and at an acute angle with the longitudinal direction. The outer side 13 of the coupling block 1 includes an abutment face 15 at the front end. A recess 16 is defined in the outer side 13 and located behind the abutment face 15 and in communication with the insertion hole 12. The outer side 13 of the coupling block 1 further includes a pressing face 17 behind the recess 16. The outer side 13 of the coupling block 1 further includes an inclined guiding face 18 located behind the pressing face 17.

The pressing block 2 is mounted to the outer side 13 of the coupling block 1 and includes outer and inner sides 21 and 22 spaced in the width direction perpendicular to the longitudinal direction. A pin 24 is mounted to the inner side 22 at a location corresponding to the recess 16 and the pressing edge 121. In the form shown, the pressing block 2 includes two lugs 23. Two ends of the pin 24 are rotatably received in the lugs 23. Thus, the pin 24 can rotate relative to the lugs 23. However, the pin 24 can be integrally formed with the pressing block 2. The inner side 22 of the pressing block 2 includes a front, abutment end 25 corresponding to the abutment face 15 of the coupling block 1. The inner side 22 of the pressing block 2 further includes a first surface 26 and a second surface 27 located behind the first surface 26 and having a slope different from that of the first surface 26. A fulcrum 28 is located between the first and second surfaces 26 and 27. The first surface 26 is located between the fulcrum 28 and the front, abutment end 25 of the pressing block 2. The first and second surfaces 26 and 27 are located corresponding to the pressing face 17. The outer side 21 of the pressing block 2 includes a pressing portion 29 corresponding to the second surface 27. The rear end of the pressing block 2 further includes a rear, arcuate, guiding end 291 spaced from the front, abutment end 25 in the longitudinal direction.

Figure 4:
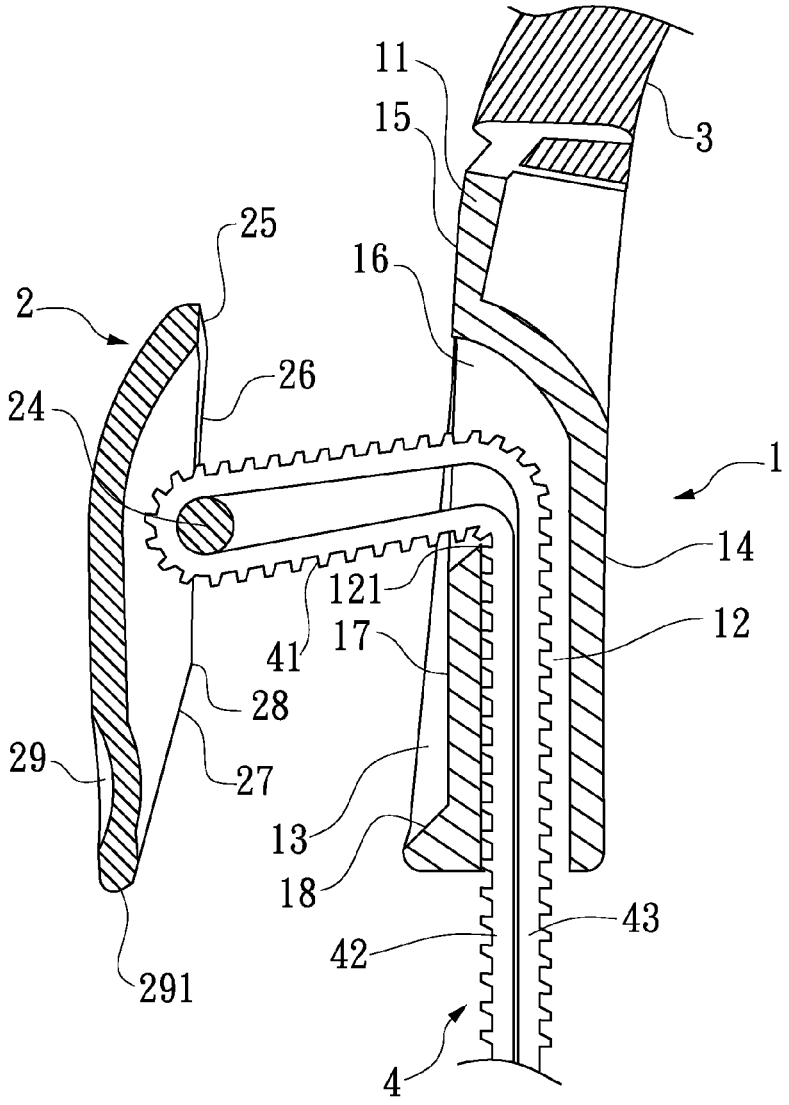
FIG. 4 shows a cross sectional view of a portion of the swimming/diving goggles of FIG. 3, illustrating assembly of the buckle and a head strap.
Figure 5:
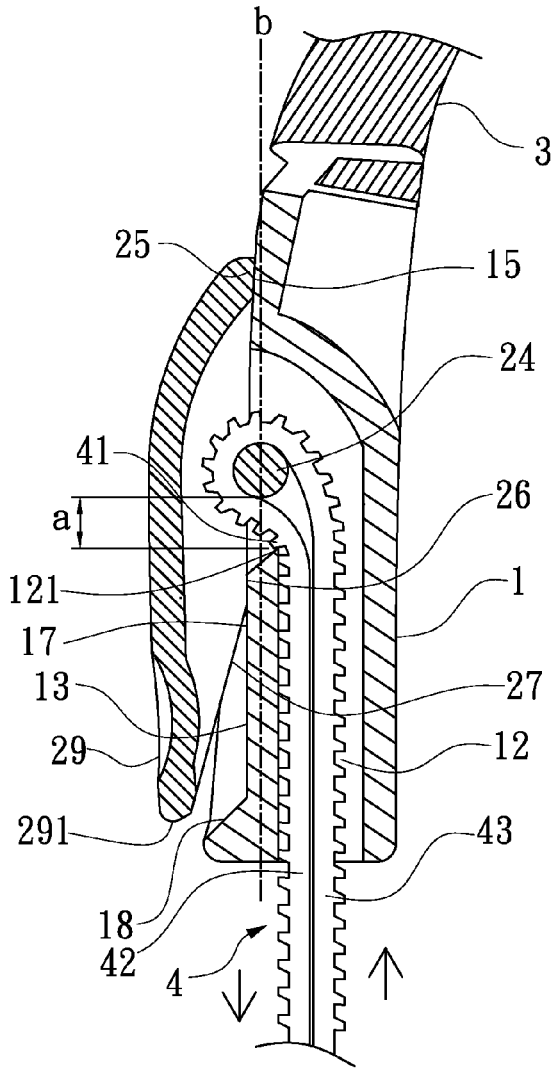
FIG. 5 is a view similar to FIG. 4, illustrating tightening of the head strap.

With reference to FIGS. 4 and 5, in assembly, an end of the head strap 4 is extended forwards into the insertion hole 12 of the coupling block 1 and wound around the pin 24 and then extended rearwards out of the insertion hole 12. Thus, the head strap 4 is folded in two and includes an outer section 42 and an inner section 43. The teeth 41 of the head strap 4 are positioned corresponding to the pressing edge 121.

With reference to FIG. 5, when the outer section 42 of the head strap 4 is pulled away from the coupling block 1, the pressing block 2 abuts the coupling block 1. The front, abutment end 25 of the coupling block 2 abuts the abutment face 15 of the coupling block 1. The first surface 26 and a side of the fulcrum 28 of the pressing block 2 press against the pressing face 17 of the coupling block 1. The second surface 27 of the pressing block 2 is spaced from the pressing face 17 of the coupling block 1 in the width direction perpendicular to the longitudinal direction. When the outer section 42 of the head strap 4 is pulled away from the coupling block 1, the moving direction of the head strap 4 does not correspond to the movement direction of the pin 24, and the pin 24 has a spacing a to the pressing edge 121 in the longitudinal direction. Thus, a user can pull the outer section 42 of the head strap 4 to adjust the tightness of the head strap 4. The pin 24 rotates while the user is adjusting the tightness of the head strap 4, providing smooth adjustment. Note that a center of the pin 24 is located on a central line b parallel to the longitudinal direction.

Figure 6:
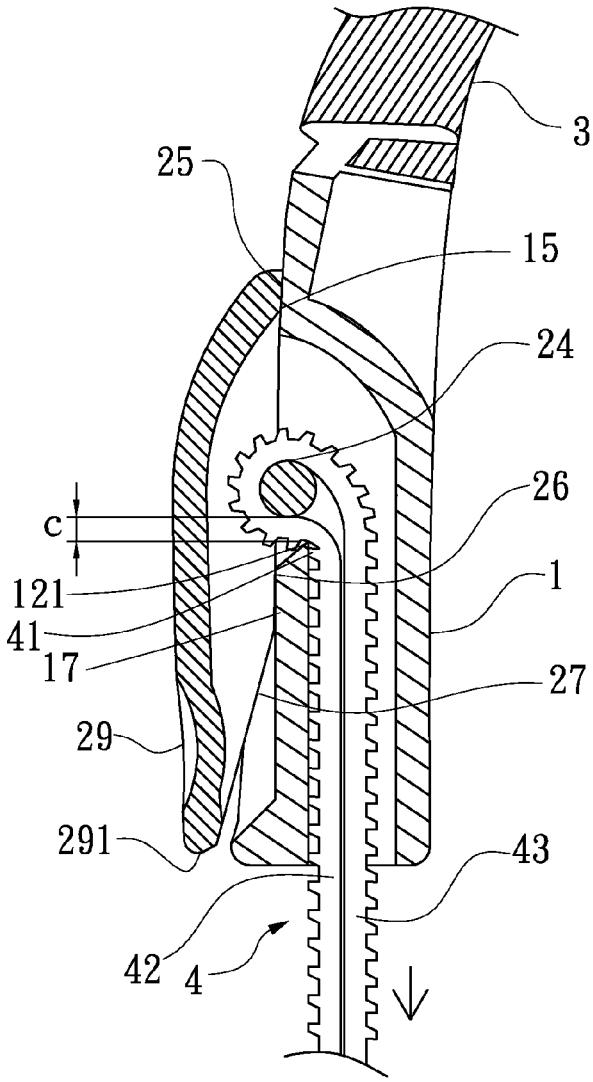
FIG. 6 is a view similar to FIG. 5, wherein the head strap is released and positioned after adjustment.

With reference to FIG. 6, when the user releases the outer section 42 of the head strap 4 after adjustment, a clamping force of the inner section 43 of the head strap 4 corresponds to the movement direction of the pin 24, such that the pin 24 moves towards the pressing edge 121 of the coupling block 1, shortening the spacing (now designated c) between the pin 24 and the pressing edge 121 in the longitudinal direction. Thus, the head strap 4 is positioned. The larger the clamping force of the head strap 4, the tighter the head strap 4 exerting on the pin 24 to press against the pressing edge 121. The head strap 4 can not be loosened by operating the inner section 43 of the head strap 4, providing stability in the adjustment and positioning.

Figure 7:
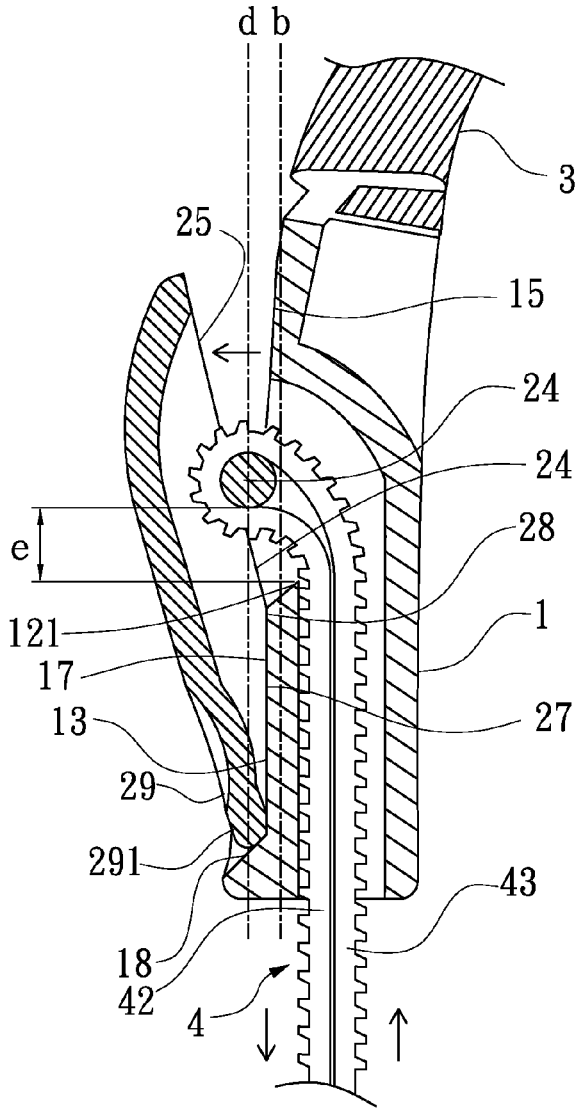
FIG. 7 is a view similar to FIG. 5, wherein the buckle is pivoted to a position allowing loosening of the head strap.
Figure 8:
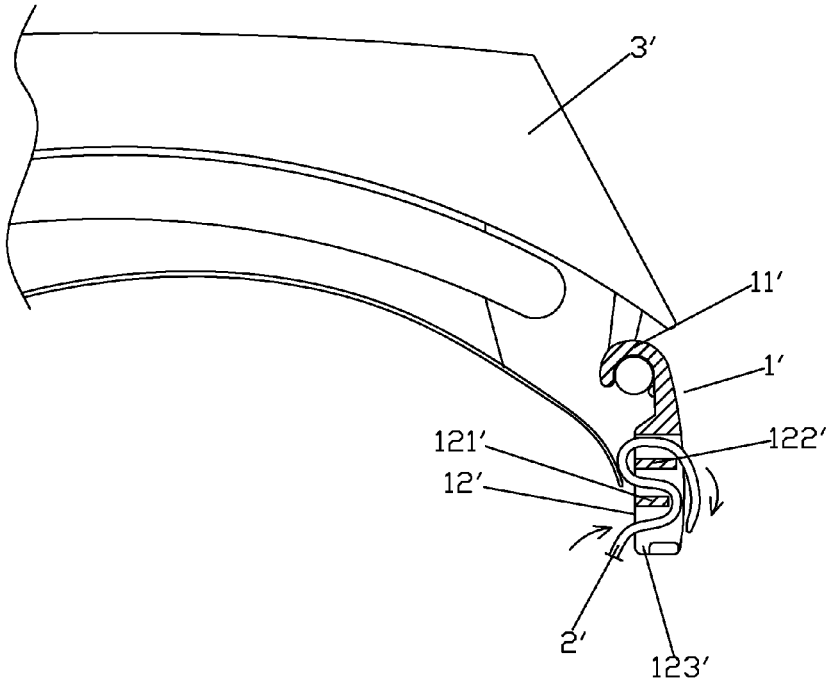
FIG. 8 shows a portion of a pair of conventional swimming goggles.
Figure 9:
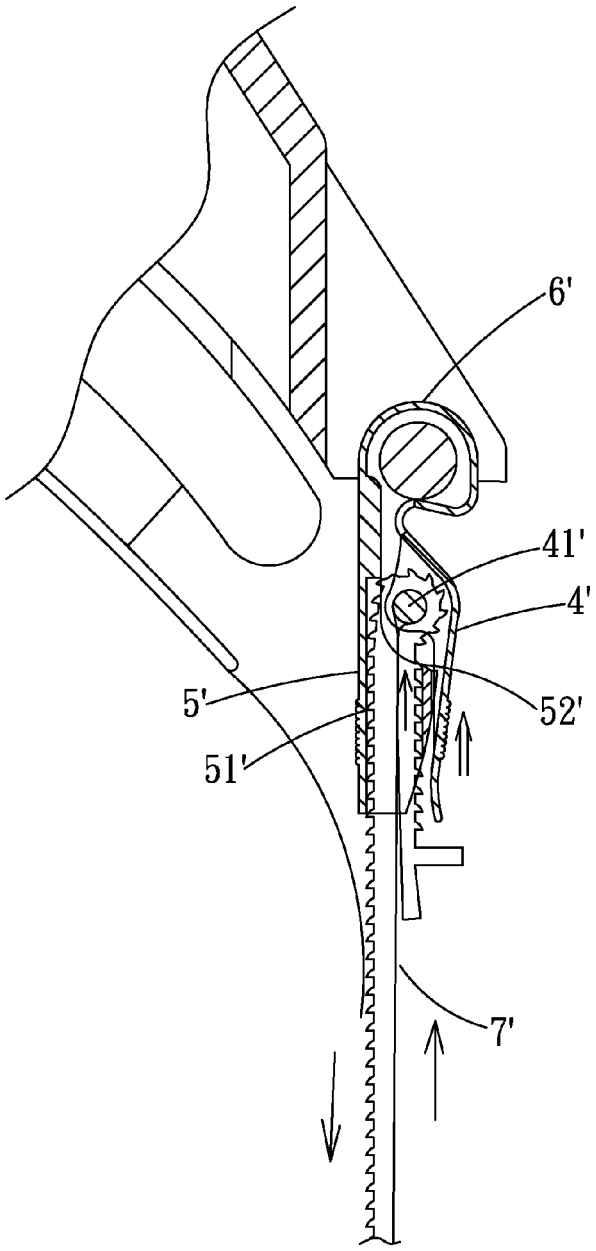
FIG. 9 shows a portion of another pair of conventional swimming goggles.
Figure 10:
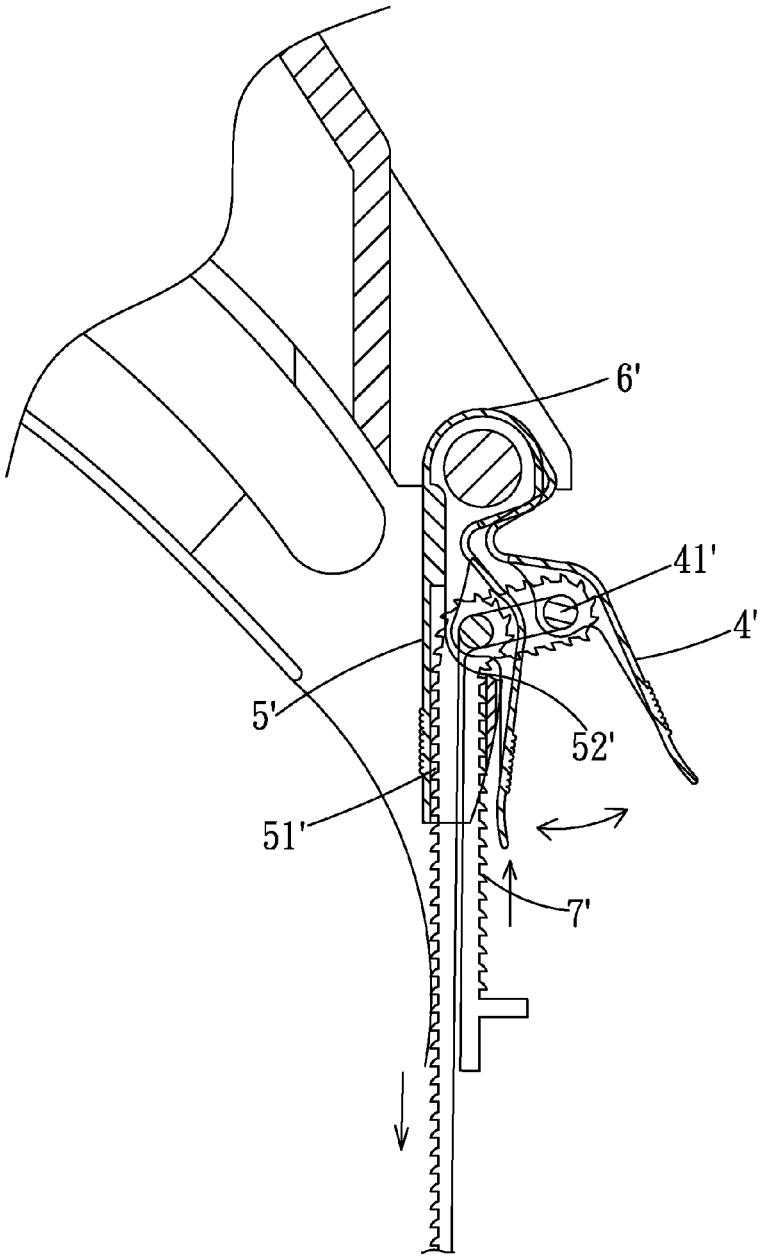
FIG. 10 shows a view similar to FIG. 9, illustrating adjustment of a head strap of the conventional swimming goggles in FIG. 9.

With reference to FIG. 7, when the user intends to loosen the head strap 4, the user presses the pressing portion 29 of the pressing block 2, causing the pressing block 2 to pivot relative to the pressing face 17 of the coupling block 1 about the fulcrum 28. The pin 24 moves away from the pressing edge 121 of the coupling block 1 in the width direction perpendicular to the longitudinal direction. Note that the center of the pin 24 is located in a center line d spaced from the center line b in the direction perpendicular to the longitudinal direction. The spacing (now designated e) between the pin 24 and the pressing edge 121 in the longitudinal direction is larger than the spacing a in FIG. 5. Thus, the user can loosen the head strap 4 by pulling the inner section 43 of the head strap 4. The rear, arcuate, guiding end 291 of the pressing block 2 slides along the inclined guiding face 18 of the coupling block 1 to provide smooth operation. The second surface 27 of the coupling block 2 presses against the pressing face 17 of the coupling block 1, restricting the maximum angular movement of the coupling block 2 and enhancing stable pressing of the coupling block 2.

Although specific embodiments have been illustrated and described, numerous modifications and variations are still possible without departing from the essence of the invention. The scope of the invention is limited by the accompanying claims.

The invention claimed is:

1. A buckle for swimming/diving goggles, with the buckle adapted to be mounted to a side of a body of the swimming/diving goggles and adapted to mount a head strap, with the buckle comprising:

a coupling block including a front end having a coupling portion engaged with the body, with the coupling block further including a rear end spaced from the front end of the coupling block in a longitudinal direction, with the rear end of the coupling block having an insertion hole receiving the head strap, with the coupling block further including outer and inner sides spaced in a width direction perpendicular to the longitudinal direction, with the insertion hole including an inner peripheral wall, with the inner peripheral wall including a front end having a pressing edge facing the outer side of the coupling block, with a recess defined in the outer side of the coupling block and in communication with the insertion hole, with the outer side of the coupling block further including a pressing face behind the recess; and a pressing block mounted to the outer side of the coupling block and including outer and inner sides spaced in the width direction perpendicular to the longitudinal direction, with a pin mounted to the inner side of the pressing block at a location corresponding to the recess and the pressing edge of the coupling block, with the pin having a spacing to the pressing edge of the coupling block in the longitudinal direction, with the inner side of the pressing block including a first surface and a second surface located behind the first surface and having a slope different from that of the first surface, with a fulcrum located between the first and second surfaces and abutting the pressing face of the coupling block, with the first and second surfaces located corresponding to the pressing face of the coupling block, with the outer side of the pressing block including a pressing portion corresponding to the second surface, wherein an end of the head strap is extended forwards into the insertion hole of the coupling block and wound around the pin and extended rearwards out of the insertion hole, with the head strap folded in two and including an outer section and an inner section, and wherein when the pressing portion of the coupling block is pressed, the pressing block pivots relative to the pressing face of the coupling block about the fulcrum, the pin moves away from the pressing edge of the coupling block in the direction perpendicular to the longitudinal direction, increasing the spacing between the pin and the pressing edge in the longitudinal direction, allowing loosening of the head strap.

2. The buckle for swimming/diving goggles as claimed in claim 1, with the outer side of the coupling block including an abutment face at the front end of the coupling block, with the inner side of the pressing block including a front, abutment end corresponding to the abutment face of the coupling block, with the first surface located between the fulcrum and the front, abutment end of the pressing block.

3. The buckle for swimming/diving goggles as claimed in claim 1, with the outer side of the coupling block further including an inclined guiding face located behind the pressing face, with the pressing block further including a rear, arcuate, guiding end spaced from the front, abutment end in the longitudinal direction, with the rear, arcuate, guiding end of the pressing block moving along the inclined guiding face of the coupling block when the pressing block is pressed.

4. The buckle for swimming/diving goggles as claimed in claim 1, with the pin is integrally formed with the coupling block.

5. The buckle for swimming/diving goggles as claimed in claim 1, with the pressing block including two lugs, with two ends of the pin rotatably received in the two lugs.

6. The buckle for swimming/diving goggles as claimed in claim 1, with the pressing edge of the coupling block at an acute angle with the longitudinal direction.

7. The buckle for swimming/diving goggles as claimed in claim 1, with the head strap including a plurality of teeth.

* * * * *